US005083168A

United States Patent [19]

Kusaka et al.

[11] Patent Number: 5,083,168

[45] Date of Patent: Jan. 21, 1992

[54] FIXING DEVICE AND FIXING HEATER FOR USE IN THE SAME

[75] Inventors: Kensaku Kusaka, Kawasaki; Yoshihiko Suzuki, Tokyo; Shigeo Kimura, Yokohama; Atsushi Hosoi, Kawasaki; Hiroyuki Adachi, Tokyo; Masahide Kinoshita, Yokohama, all of Japan

[73] Assignee: Canon Kabushiki Kaisha, Tokyo, Japan

[21] Appl. No.: 430,437

[22] Filed: Nov. 2, 1989

[30] Foreign Application Priority Data

Nov. 15, 1988 [JP] Japan ..... 63-287940
Nov. 25, 1988 [JP] Japan ..... 63-297369

[51] Int. Cl.[5] ..... G03G 15/20

[52] U.S. Cl. ..... 355/285; 219/216; 219/469; 355/289

[58] Field of Search ..... 355/285, 289, 290, 282; 219/216, 243, 244, 388, 494, 481, 510, 517, 469–471; 346/160

[56] References Cited

U.S. PATENT DOCUMENTS 3,578,797 5/1971 Hodges et al. ..... 219/388
3,916,256 10/1975 Kotani ..... 219/216
4,566,779 1/1986 Coli et al. ..... 355/3 R

FOREIGN PATENT DOCUMENTS 0295901 12/1988 European Pat. Off. ..... 355/285
0018747 2/1979 Japan ..... 355/285
0101851 5/1988 Japan ..... 355/285
63-160128 7/1988 Japan .

*Primary Examiner*—A. T. Grimley
*Assistant Examiner*—Thu Dang
*Attorney, Agent, or Firm*—Fitzpatrick, Cella, Harper & Scinto

[57] ABSTRACT

A fixing device includes a heating element fixedly supported during a fixing procedure, a film, apparatus enabling the film to slide against the heating element, and a pressurizing roller for pressing a recording material on which a toner image is supported against the film. The heating element has a substrate, a heat generating layer provided on the substrate, and a heat-melting portion provided on the substrate. The heat-melting portion melts at a temperature higher than the fixing temperature and lower than the withstanding temperature of the substrate and thereby disconnects the heat generating layer from its power source.

46 Claims, 7 Drawing Sheets

23
51
52
53
22
47
48
49
50
48
T9
T10

FIXING DEVICE AND FIXING HEATER FOR USE IN THE SAME

BACKGROUND OF THE INVENTION

1. Field of the Invention

The present invention relates to a fixing heater for fixing a toner image on a recording material, as well as a fixing device employing the same.

2. Description of the Related Art

The heat roller fixing method has been widely adopted for fixing a toner image on a recording medium.

It has also been proposed to fuse a toner through a web, as is disclosed in the specification of U.S. Pat. No. 3,578,797.

However, the above-described fixing methods employ a heating roller whose heat capacity is very large, and this makes the warming up time required for the roller long and necessitates application of high power.

In order to solve this problem, the present inventors have filed application Ser. No. 206.767, and proposed a fixing device whose heat capacity is small, which requires low power, and whose warming up time is short.

Furthermore, in the above-described types of heat fixing devices, a temperature fuse or a thermostatic switch is provided as a safety measure on the surface of a heat roller so as to forcibly de-energize the heater when the temperature thereof rises excessively.

When such safety measures as a temperature fuse or a thermostatic switch are applied to the fixing heater having a wire-like heat generating layer whose heat capacity is small, the response is delayed because they cannot be disposed in the heat generating portion. Furthermore, the warming up time is prolonged due to the large thermal capacity of the temperature fuse or of the thermostatic switch.

SUMMARY OF THE INVENTION

An object of the present invention is to provide a fixing heater which is capable of being disconnected from its power source without the warming up time thereof being prolonged when the temperature thereof rises excessively, as well as a fixing device which employs the same.

Another object of the present invention is to provide a fixing heater which is capable of being disconnected from its power source without employing a special member such as a temperature fuse or a thermostatic switch when the temperature thereof rises to an excessively high value, as well as a fixing device employing the same.

To this end, the present invention provides a fixing device which comprises: a heating element fixedly supported during the fixing; a length of film; means causing the film to slide against the heating element; and pressurizing means for pressing a recording material on which a toner image is supported against the film. The heating element includes a substrate, a heat generating layer provided on the substrate, electrodes through which the heat generating layer is energized, and a heat-melting portion which melts at a temperature higher than the fixing temperature and lower than the withstanding temperature of the electrodes or of the substrate and thereby disconnects the heat generating layer from its power source when its melting temperature is reached.

In another form of the present invention, the heating element includes a substrate, a heat generating body provided on the substrate, and electrodes through which the heat generating layer is energized. The portion of the heating layer located outside a fixing area has a cross-sectional area smaller than that of the portion thereof located within the fixing area.

BRIEF DESCRIPTION OF THE DRAWINGS

FIG. 2 (*b*) shows another example of a film employed in the fixing device of FIG. 2 (*a*);

FIG. 9 (*b*) is a section taken along the line b—b of FIG. 9 (*a*);

FIG. 9 (*c*) is a section taken along the line c—c of FIG. 9 (*a*);

FIG. 10 (*b*) is a section taken along the line b—b of FIG. 10 (*a*); and FIG. 10 (*c*) is a section taken along the line c—c of FIG. 10 (*a*).

DETAILED DESCRIPTION OF THE PREFERRED EMBODIMENTS

Figure 1:
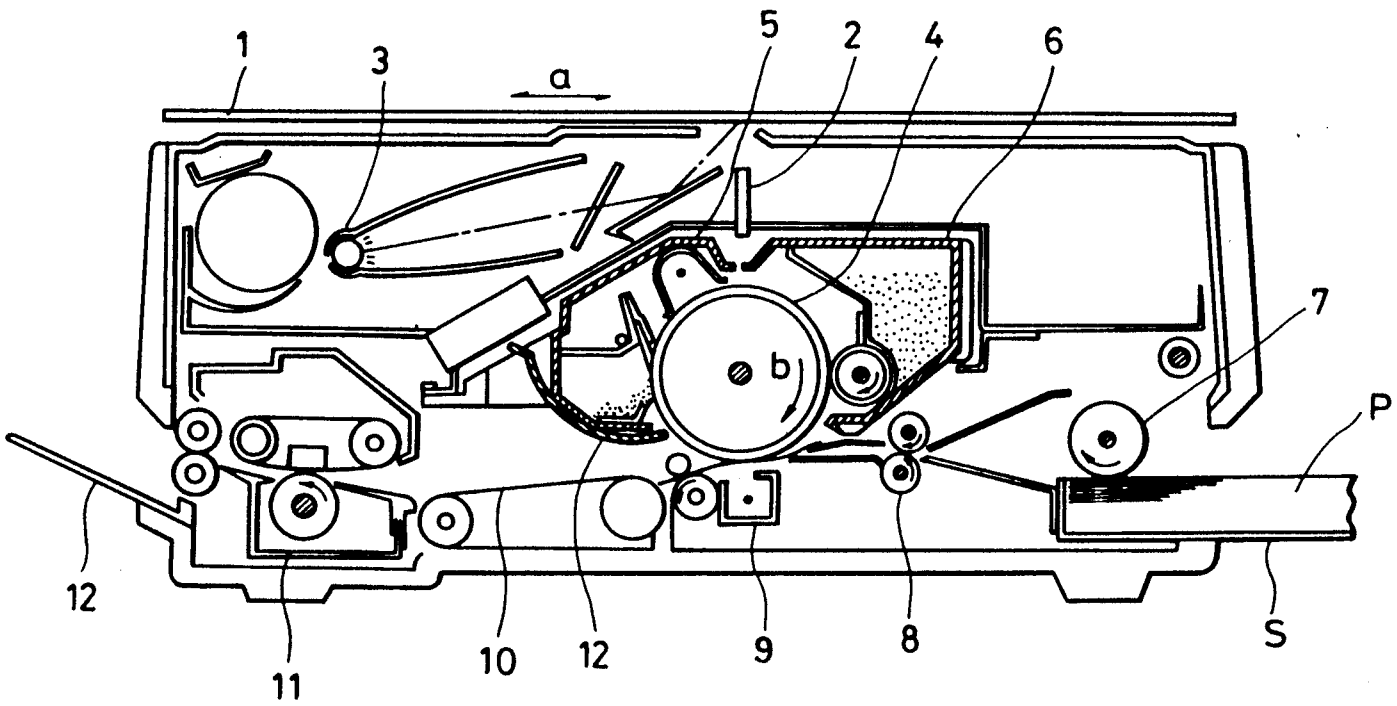
FIG. 1 is a cross-sectional view of an electrophotographic copier to which the present invention is applied.

The present invention will now be described below by way of example with reference to the accompanying drawings in which the same reference numerals are used to denote respective parts which have identical functions.

FIG. 1 is a cross-sectional view of a copier to which an embodiment of the fixing device according to the present invention is applied.

A document base 1 is made of a transparent member such as glass. It is movable back and forth in the direction indicated by the arrow a, whereby an original document is scanned. Immediately below the document base 1 is disposed an array 2 of short-focal-point, small-diameter image forming elements. An original document placed on the document base 1 is irradiated with an illumination lamp 3, and the light reflected by the document passes through the slit of the array 2 and reaches a photosensitive drum 4. The photosensitive drum 4 is rotatable in the direction indicated by the arrow b. A zinc oxide or organic semiconductor photosensitive layer coated on the surface of the photosensitive drum 4 is uniformly charged by a charger 5. The drum 4 uniformly charged by the charger 5 is exposed to the light that has passed through the array 2 whereby a latent image is formed on the drum. The latent image is made visible by a developer 6 using a toner which may be a resin which melts by the application of heat. A sheet P of recording paper placed on the top of a pile accommodated in a cassette S is fed onto the surface of the drum 4 by a feeding roller 7 and a pair of conveying rollers 8 which are disposed in alignment in the vertical direction and which are rotated in a state wherein they are in contact with each other in such a manner as to be synchronized with the rotation of the drum 4. A transfer discharger 9 transfers the toner image formed on the surface of the photosensitive drum 4 onto the sheet P located on the drum 4. Thereafter, the sheet P is separated from the drum 4 by a known separation means, is led to a fixing device 11 by means of a conveying guide 10 where thermal fixing process is conducted on the sheet P, and is then discharged onto a tray 12. The toner particles remaining on the drum 4 after the transfer are removed from the drum 4 by a cleaner 12.

Figure 2A:
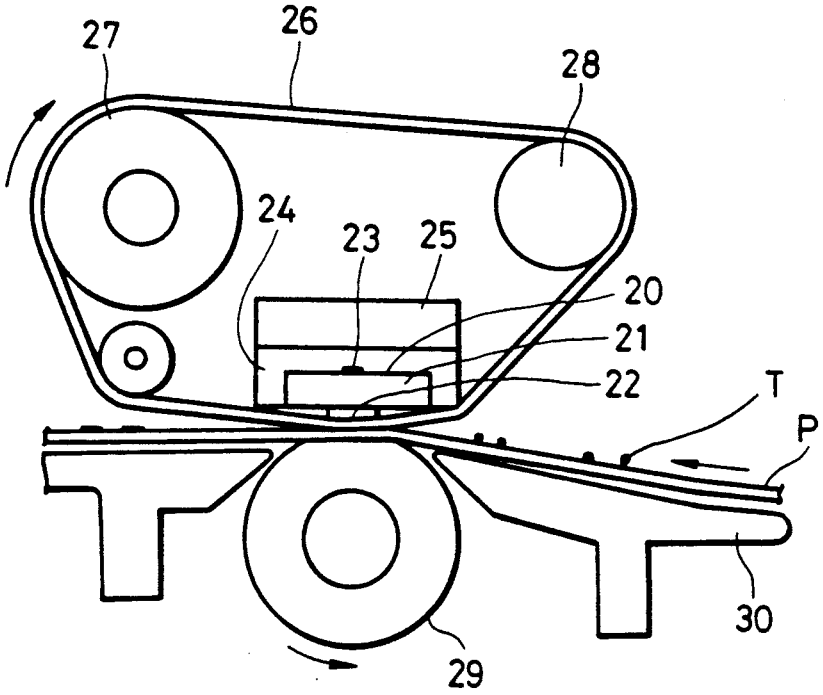
FIG. 2 (*a*) is an enlarged cross-sectional view of an embodiment of a fixing device according to the present invention.
Figure 2B:
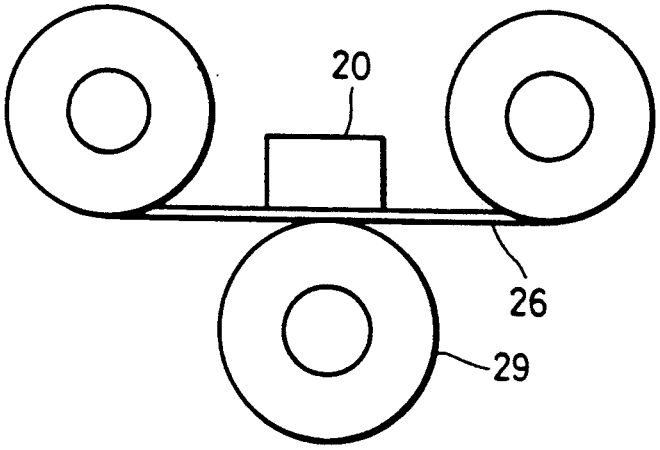

FIG. 2 (*a*) is an enlarged cross-sectional view of the fixing device 11 according to the present invention. A heating element 20 of the fixing device includes an alumina substrate 21 having a flat plate-like shape, and a wire-like resistor 22 whose heat capacity is small, which is coated on the alumina substrate 21. The resistor 22 is energized at the longitudinal two ends thereof by application of 100 V d.c. having a pulse-like form and a period of 20 msec. A temperature detecting element such as a thermistor is provided on the substrate 21. The pulse width of the waveform applied to the resistor 22 is varied in the range from 0.5 msec to 5 msec so that the temperature detected by the detecting element is kept at a predetermined value.

The heating element 20 whose energization is controlled in the manner described above is fixedly supported on the fixing device by a supporting member having a high rigidity such as steel with a heat-insulating supporting member 24 made of a heat-resistant resin such as PPS or polyamide being interposed therebetween. The heating element 20 is supported by a holder 25.

A fixing film 26 is conveyed under an adequate tension without any wrinkle generated in the film by a driving roller 27 and a driven roller 28 in the direction indicated by the arrow in a state wherein it is in contact with the heating element 20. The portion of the wire-like resistor 22 of the heating element 20 which slides against the fixing film 26 is covered by a protective layer made of a heat-resistant glass or a heat-resistant resin.

The fixing film 26 may be an endless film in which a releasing layer is coated in a thickness of 10 μm at least on the surface of a heat-resistant film of a thickness of 20 μm which makes contact with an image. The releasing layer may be made of a fluororesin, such as PTFE, PFA or FEP, to which a conductive material such as carbon black is added. The heat-resistant film may be made of a heat-resistant resin, such as polyimide (PI), polyetherimide (PEI), polyethersulfone (PES), perfluoroalkoxy (PFA) or polyketonesulfide (PKS). The thickness of the fixing film 26 is generally set to 100 μm or less, preferably, from 10 μm to 40 μm with heat-conductivity being taken into consideration.

A pressurizing roller 29 has an elastic layer which may be made of a rubber having an excellent releasing property, such as silicone rubber. The roller 29 is rotated during which time it presses against the heating element 20 through the fixing film 26 at a pressure of about 4 to 7 Kg per the width of a recording material having an A4 size.

Unfixed toner T on the recording material P is led into the fixing portion by an inlet guide 30, where it is fixed to the recording material P by means of heat.

The above-described embodiment employs the fixing film which is an endless film. However, the fixing film may also be a film having a certain length extending between feed and take-up rolls, as shown in FIG. 2 (*b*).

The apparatus to which the fixing device according to the present invention can be applied is not limited to a copier; the fixing device according to the present invention can be applied to all the apparatuses of the type in which an unfixed toner image is formed on a recording medium, including an optical printer, a magne-stylus printer and so on.

Figure 3:
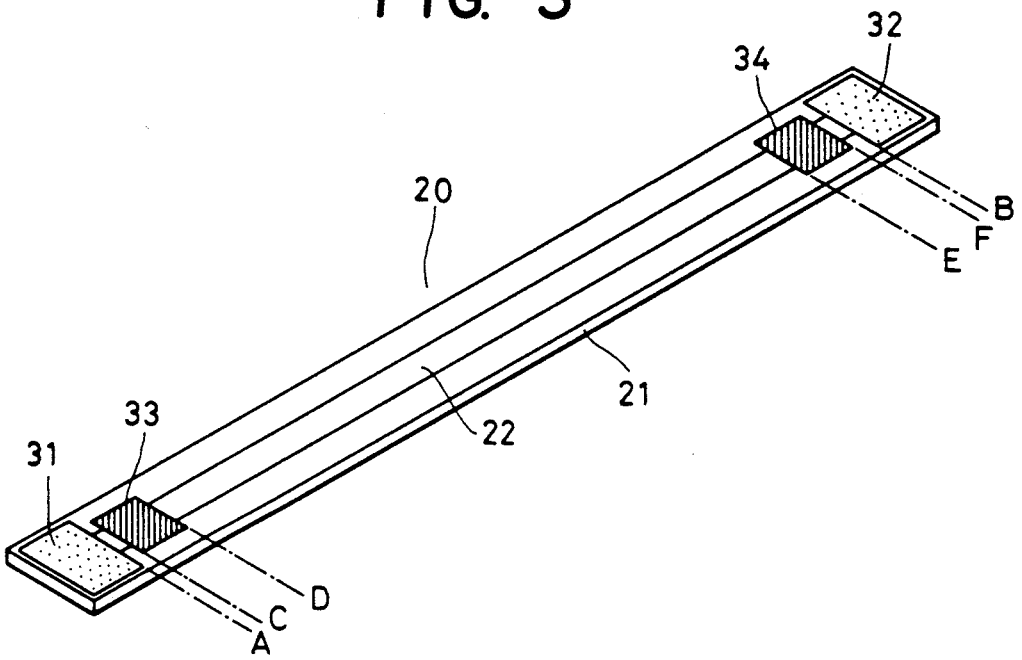
FIG. 3 is a perspective view of a fixing heater of the fixing device of FIG. 2 (*a*)

Next, the heating element 20 which is the fixing heater according to the present invention will be described in detail with reference to FIG. 3 which is an enlarged view of the heater 20.

The alumina substrate 21 has dimensions of 1.0 mm (thickness)×10 mm (width)×260 mm (length). The resistor 22 which is coated on the substrate 22 has dimensions of about 10 μm (thickness)×1.0 mm (width)×220 mm (length). The resistor 22 is made of a material which possesses the property of electric resistance and whose melting point is high, such as silver/palladium, ruthenium oxide or nickel. Electrodes 31 and 32 made of, for example, silver are coated at the longitudinal two ends of the alumina substrate 21. Power is supplied from an external circuit to the electrodes 31 and 32 through connectors which are not shown. The resistors 22 are connected to the electrodes 31 and 32 through contacts 33 and 34 whose melting point is higher than the fixing temperature and lower than that of the electrodes 31 and 32 and of the alumina substrate 21. Each of the contacts 33 and 34 is made of a material having a resistivity lower than that of the resistor 22. It has dimensions of about 100 μm (thickness )×2.0 mm (width)×5.0 mm (length). The material of each of the contacts 33 and 34 is selected from those whose melting point is higher than that to which the heating body is heated during the fixing operation and lower than that at which the fixing device is damaged or at which the transfer material begins to emit smoke or burn. For example, lead, tin and solder may be used as the material of the contacts 33 and 34. In this embodiment, the heating element is controlled so that it is kept at 180° C. during the fixing. The heat-insulating member 24 which supports the heating element 20 is made of PPS whose maximum withstanding temperature is 260° C. Hence, the contacts 33 and 34 are made of tin whose melting point is 232° C.

Thus, when the heating element is heated to an excessively high temperature higher than the melting point of the contacts 33 and 34 due to the failure of a thermistor or the malfunction of the control system, the contacts 33 and 34 melt, thus disconnecting the heat generating resistor 22 from its power source and thereby preventing burning of the recording material and the damage to the substrate of the heating element 20. Furthermore, the contacts 33 and 34 are the thin layers coated on the substrate, and therefore do not substantially increase the heat capacity of the heater.

Figure 4:
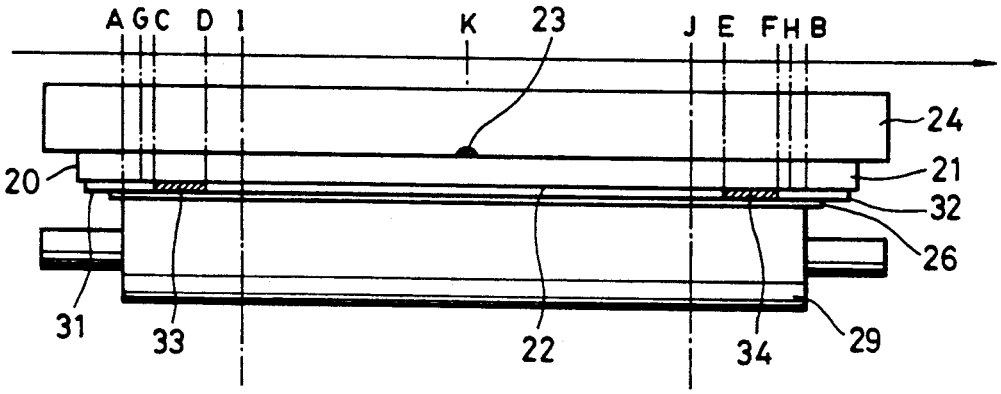
FIG. 4 explains the fixing device of FIG. 2 (*a*)

FIG. 4 illustrates the positional relationship in the longitudinal direction in the fixing device. The longitudinal length DE of the resistor 22 which is the heat generating portion of the heating element 20 is larger than the maximum recording material passing area IJ, which is the fixing area, and this enables the recording material to be heated uniformly over the entire longitudinal length thereof during the fixing.

The temperature detecting element 23, as shown in FIG. 2 (*a*), is disposed at the center K of the recording material passing area.

The contacts 33 and 34 are respectively located at CD and EF inside of the contact portion AB between the heating body 20 and the pressurizing roller 29, whose the heat radiation characteristics are substantially the same as those of the position K of the temperature detecting element 23. This means that the temperature of the contacts 33 and 34 is substantially the same as that detected by the temperature detecting element 23. Auxiliary heat generating portions GC and FH, which are made of the same material as that of the resistor 22, are respectively provided between the contact 33 and the electrode 31 and between the contact 34 and the electrode 32 for the purpose of preventing lowering of the temperature of the contacts 33 and 34 caused by the radiation of heat from the contacts 33 and 34 to the electrodes 31 and 32. Since the width AB of the pressurizing roller 29 is larger than the distance GH between the electrodes, heating of the auxiliary heat generating portions GC and FH and the contacts 33 and 34 to an excessively high temperature can be prevented.

Next, the operation of the contacts 33 and 34 will be described below.

i) During the stable fixing operation

The maximum temperature to which the contacts 33 and 34 are heated is about 220° C. with heating of the contacts serving as the non-recording paper passing areas to a temperature higher than usual caused by the passing of recording materials having a small size or with the response time of the temperature detecting element 23 being taken into consideration. In consequence, the contacts 33 and 34 do not melt, and the resistor 22 is therefore energized through the electrodes 31 and 32.

ii) During the anomaly

When control of the temperature of the heating element 20 is disabled and the heating element 20 is thereby heated to 180° C. or above due to the breaking or the contact failure of the temperature detecting element 23 to heat the alumina substrate to 232° C. or above, the contacts 33 and 34 melt and undergo fission between the electrode 31 or 32 and the resistor 22 due to the surface tension of tin, electrically isolating the resistor 22 from the electrode 31 or 32.

This disables the supply of power to the resistor 22, and heating of the heating element 20 therefore stops. At that time, no damage is done to the fixing device, and no smoke emits from the recording material located in the fixing portion.

Although the heat-melting contact may be provided at one point, it is preferable for a plurality of them, in particular, two of them, to be provided one at each end, from the viewpoint of safety.

Figures 5A, 5B, 5C, 6A, 6B, 6C:
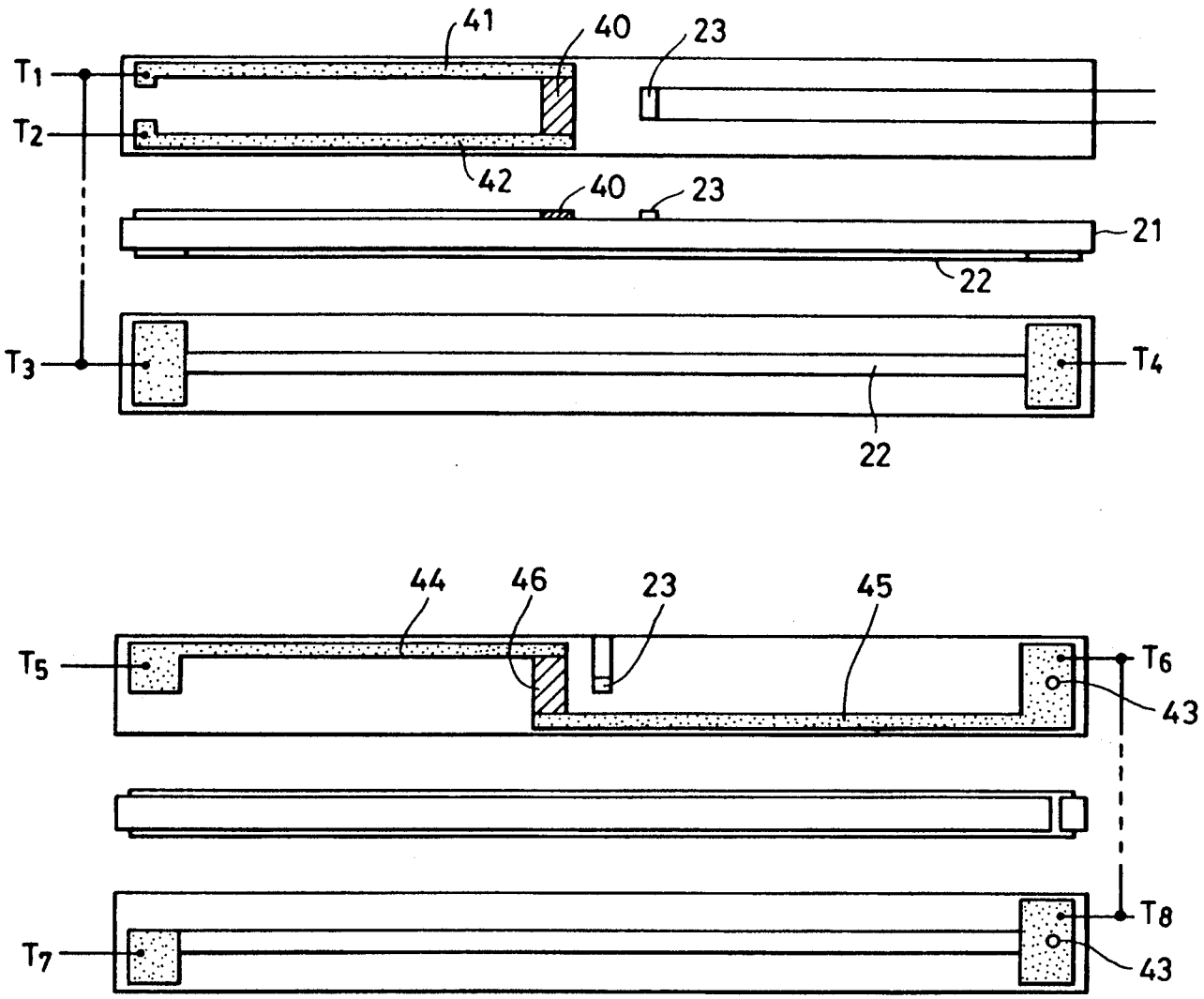
FIGS. 5 (*a*), 5 (*b*) and 5 (*c*) are respectively plan, side and bottom views of another example of a fixing heater according to the present invention.
FIGS. 6 (*a*), 6 (*b*) and 6 (*c*) are respectively plan, side and bottom views of another example of a fixing heater according to the present invention.

FIG. 5 comprises FIG. 5 (*a*), FIG. 5 (*b*) and FIG. 5 (*c*) which are respectively plan, side and bottom views of another example of a fixing heater.

In this fixing heater, terminals T1 and T2 are electrically connected, and a voltage is applied from a voltage source (not shown) to terminals T2 and T4.

Electrodes 41 and 42 made of silver are electrically connected by a heat-melting contact 40 made of tin. The contact 40 has dimensions of 100 μm (thickness)×2.0 mm (width). The electrodes 41 and 42 are separated from each other by a distance of 5.0 mm.

The heat-melting contact 40 is provided substantially at the center of the recording material passing area, which is the fixing area. It is provided on the surface of the substrate opposite to that on which the resistor 22 is provided and in the vicinity of the temperature detecting element 23.

With the contact 40 being provided substantially at the center of the recording material passing area which is the fixing area, heating of the contact 40 to a temperature higher than usual can be prevented, which would occur during the continuous fixing operation if it is located in the non-recording material passing area. In consequence, the contact 40 is heated to a temperature lower than that to which the fixing heater in the embodiment shown in FIG. 3 is heated during the normal fixing operation, and this enables erroneous melting of the contact which may be caused by the excessive temperature or the like during the normal operation to be prevented.

As a result, a material which melts at a low temperature can be used as the material of the contact, and this further increases the safety.

FIG. 6 comprises FIG. 6 (*a*), FIG. 6 (*b*) and FIG. 6 (*c*) which are plan, side and bottom views of another example of a fixing heater.

In this fixing heater, terminals T6 and T8 are electrically connected through a through-hole 43, and a voltage is applied from a voltage source (not shown) to terminals T5 and T7.

Electrodes 44 and 45 made of silver are electrically connected by a heat-melting contact 46 made of tin. The contact 46 has dimensions of 100 μm (thickness)×2.0 mm (width). The electrodes 44 and 45 are separated from each other by a distance of 5.0 mm.

This heater can be energized at one end thereof, and this makes the structure of the fixing device simple and makes the assembly thereof easy.

Figure 7:
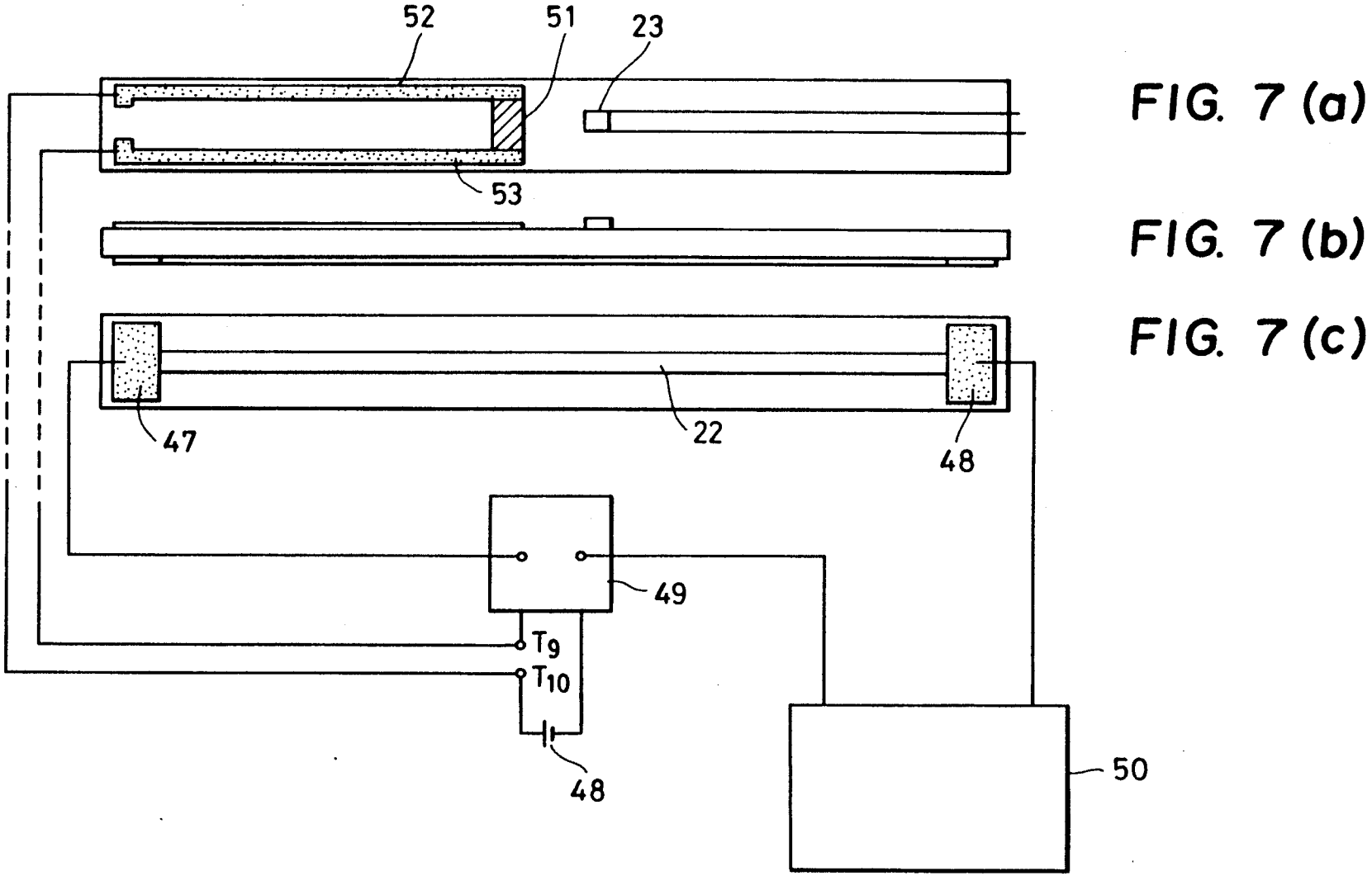
FIGS. 7 (*a*), 7 (*b*) and 7 (*c*) are respectively plan, side and bottom views of another example of a fixing heater according to the present invention.

FIG. 7 comprises FIG. 7 (*a*), FIG. 7 (*b*) and FIG. 7 (*c*) which are respectively plan, side and bottom views of another example of a fixing heater.

Electrodes 47 and 48 located at the two ends of the resistor 22 are connected to a power source 50 through a relay 49, which is driven by a second power source 48. The relay 49 is ON (short-circuiting between two terminals) while its terminals T9 and T10 are connected with each other. The relay 49 is OFF (insulation between two terminals) while the terminals are not connected. A contact 51 is connected between the terminals T9 and T10 through silver electrodes 52 and 53. The contact 51 is located substantially at the center of the heater in the longitudinal direction thereof, which is substantially the center of the recording material passing area. The material and the dimensions of the contact 51 are the same as those of the contact shown in FIG. 5.

During the fixing operation, the terminals T9 and T10 are short-circuited, and the relay 49 is therefore ON. As a result, power is supplied to the resistor 22 from the power source 50.

When the temperature of the substrate is heated excessively to the melting point of the contact 51, the contact 51 melts, electrically isolating the terminal T9 from the terminal T10. This disconnects the relay 49 from its power source, and provides isolation between the two terminals.

This in turn disconnects the resistor 22 from its power source 50, and heating of the resistor thus stops.

In this example of the fixing heater, power supplied to the resistor 22 does not flow in the contact 51.

More specifically, only the low power required to operate the relay 49 flows in the contact 51, and this makes energization of the electrodes 52 and 53 easy. A material having a large resistivity and, hence, generating a large amount of heat can be used as that of the contact In the above-described embodiments, a fixing heater in which excessive heating of the heat-melting contact has occurred is replaced with a new one.

As will be understood from the foregoing description, in the present invention, no temperature fuse or thermostatic switch is provided separately from the fixing heater; a fixing heater in which a thin heat-melting portion whose heat capacity is small is provided on the substrate. In consequence, the heat capacity of the fixing heater does not substantially increase.

As a result, the warming up time of the fixing device is not prolonged.

The above-described embodiments exemplify a fixing heater in which the heat-melting portion made of lead or tin is provided on the substrate. Next, embodiments of a fixing heater whose excessive heating can be prevented without provision of a heat-melting portion whose withstanding temperature is lower than that of the substrate or of the electrodes will be described below.

Figure 8:
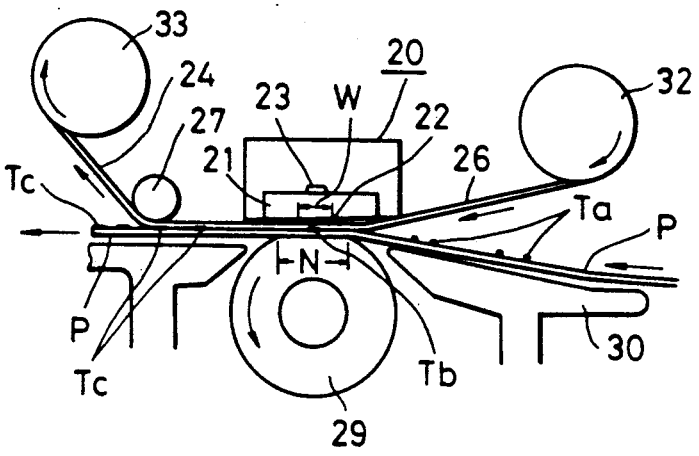
FIG. 8 is a schematic view of another example of a fixing device according to the present invention.

These embodiments can be applied to a fixing device constructed in the manner shown in FIG. 8, as well to that having the structure shown in FIGS. 2 (*a*) and 2 (*b*).

In FIG. 8, a reference symbol N denotes a contact portion between the heating element 20 and the pressurizing roller 29, W denotes the width of a wire-like heat generating layer, Ta denotes a non-fixed toner image, Tb denotes a melting toner image, and Tc denotes a cooled toner image.

Figure 9:
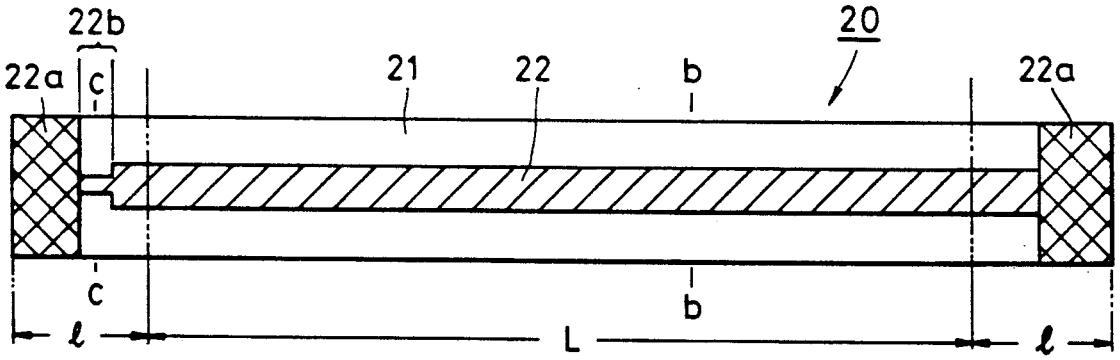
FIG. 9 (*a*) is a bottom view of a heater of the fixing device of FIG. 8.
Figure 9:
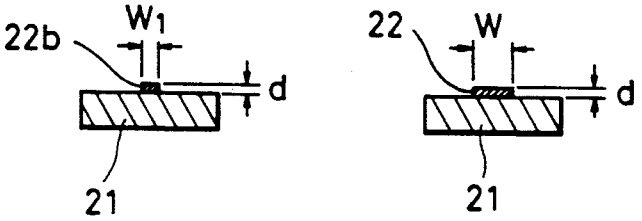

FIG. 9 (*a*) is a bottom view of a heating element 20, showing the surface thereof which slides against the fixing film 24.

A heat-resistant substrate 21 is a member which is elongated in the direction transverse to the fixing film (i.e., in the direction perpendicular to the direction in which the fixing film travels). The substrate 21 may be made of a ceramic such as alumina, a heat-resistant glass or a heat-resistant resin such as PI or PPS. A reference symbol L denotes the maximum recording material passing area which is equal to the width of the largest recording material that can pass through the fixing device. The longitudinal length of the substrate 21 is larger than the area L; the substrate 21 extends from the area L by l at each end thereof.

A wire-like heat generating portion or a strip of heat generating portion 22 is provided on the surface of the substrate 21 substantially at the center thereof in such a manner that it extends in the longitudinal direction thereof. The heat generating portion 22 has a width W. The heat generating portion 22 is made of a material which possesses the property of electric resistance, such as Ta2N, nichrome, RuO2 or Ag/Pd.

Electrodes 22*a* for the heat generating portion 22 are provided on the surface of the substrate 21 in the extending portions l located at the two ends thereof. The electrodes are made of a metal, such as Ag, Au or Cu, or a conductive material, such as RuO2 or Ag/Pd. The heat generating portion 22 is connected to the electrodes 22*a* at the two ends thereof, and is therefore energized in the longitudinal direction thereof. In this embodiment, one end of the heat generating portion 22 is connected to the corresponding electrode 22*a* through a narrow portion 22*b*. The narrow portion 22*b* is located in the extending portion l of the substrate 21. The narrow portion 22*b* has a cross-sectional area (shown in FIG. 9 (*c*)) smaller than that (shown in FIG. 9 (*b*)) of the effective length portion of the heat generating portion 22 which corresponds to the maximum recording material passing area L. In this embodiment, the narrow portion 22*b* and the effective length portion L of the heat generating portion 22 are formed from the same material as one unit. They have the same thickness d. Only the width W1 of the narrow portion 22*b* is made smaller than the width W of the effective length portion of the heat generating portion so as to reduce the cross-sectional area thereof and thereby make it serve as a heat-melting portion.

Generally, the smaller the cross-sectional area of a resistor, the faster the temperature rise under condition that the power applied to the resistor be the same. It is therefore possible to control the speed of temperature rise of the resistor by determining the cross-sectional area thereof.

During the fixing operation, the heat generating portion 22 is energized through the electrodes 22*a* and the narrow portion 22*b* so that it can be heated over the entire length thereof. At that time, the narrow portion 22*b* is also heated. The narrow portion 22*b* warms at a higher speed than the heat generating portion 22. In normal operation, the heat generating portion 22 is turned on and off so that the temperature thereof is adjusted to a predetermined value. As a result, the temperature of the heat generating portion 22 and the narrow portion 22*b* is kept at a constant value (which is lower than the melting point of the resistor) or less, which ensures a smooth fixing operation.

When abnormal energization such as continuous energization occurs due to an anomaly in the power source or in the temperature control, the heat generating portion 22 and the narrow portion 22*b* are heated excessively. In that event, it is possible to heat the narrow portion 22*b* to a melting temperature and thereby melt it before the effective length portion of the heat generating portion 22 is heated to a temperature at which the fixing film 24, the pressurizing roller 29 and the transfer material P burn and emit smoke, by setting the ratio of the width of the heat generating portion 22 to that of the narrow portion 22*b* to an adequate value. When the narrow portion 22*b* melts, the heat generating portion 22 is disconnected from its power source, and the possibility of burning and fuming can be thereby eliminated.

The narrow portion 22*b* is provided outside the recording material passing area L. So, distribution of the temperature within the recording material passing area can be made uniform, ensuring smooth, excellent fixed images. Furthermore, since the vicinity of the narrow portion can be made of a flame-resisting, heat-resisting material alone, burning or fuming can be prevented when the narrow portion is heated excessively and thereby melts due to continuous energization of the heat generating portion.

We manufactured the heating element 20 having the following specification, and incorporated that heating body in the fixing device 11 of the aforementioned image forming apparatus. We passed 30,000 sheets of transfer material P having an A4 size (a width of 210 mm) under the temperature control in which the temperature of the surface of the heating body was kept at 200° C., and found that the image fixing process could be conducted on all the recording material with no problems.

Substrate 21: alumina of 270 mm (length) × 10 mm (width) × 1 mm (thickness)

Heat generating portion 22: a *Ag/Pd* resistor of 220 mm (length) × 1.5 mm (width) × 20 μm (thickness)

Narrow portion 22*b*: *Ag/Pd* of 5 mm (length) × 300 μm (width) × 20 μm (thickness)

(Both the heat generating portion 22 and the narrow portion 22*b* are concurrently formed by the screen printing method)

We deactivated the temperature control of the heating element 20 and continuously energized the heat generating portion 22. When the recording material passing area was heated to 320° C., which is lower than the 430° C. at which it burns, the narrow portion **22*b* melted, and the heat generating portion 22** was thereby disconnected from its power source.

For the purpose of ensuring the breakage of the narrow portion **22*b*, the narrow portion 22*b* may be formed on a heat-insulating substrate made of a heat-resistant glass or the like, which would be cracked due to the thermal strain caused by the excessive heating of the narrow portion 22*b*. In this way, breakage of the melting narrow portion 22*b*** can be assured.

Figure 10:
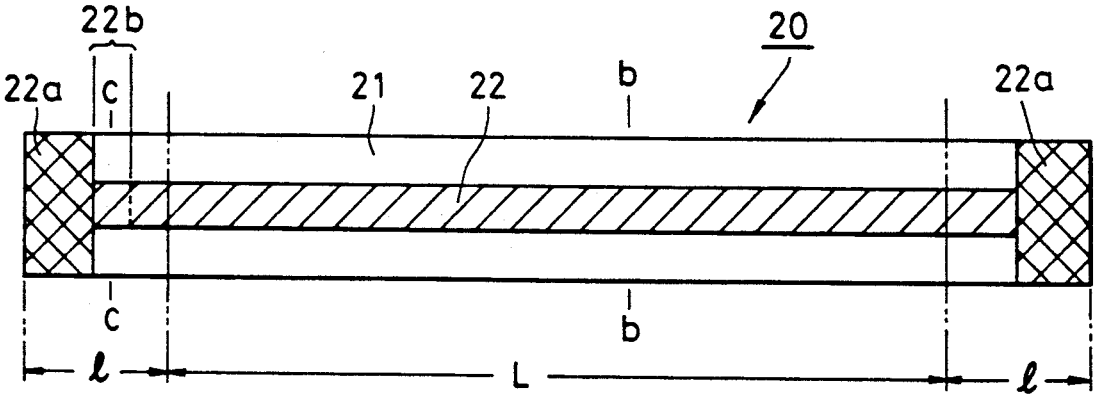
FIG. 10 (*a*) is a bottom view of another example of a heater of the fixing device of FIG. 8.
Figures 10B, 10C:
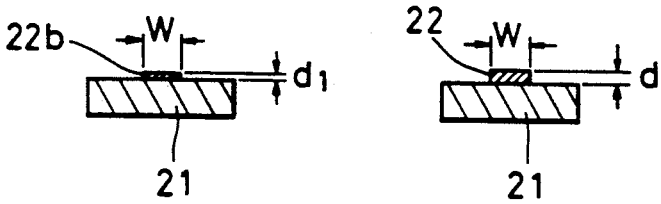

FIGS. 10 (*a*), 10 (*b*) and 10 (*c*) show a narrow portion **22*b* formed as a small cross-sectional area portion by setting the thickness d1 to a value smaller than the thickness d of the effective length portion of the heat generating portion. The narrow portion 22*b*** is made of the same material as that of the effective length portion L of the heat generating portion, and has the same width W as that of the effective length portion of the heat generating portion.

As will be understood from the foregoing description, according to the present invention, the heat capacity of the heating body which serves as a heating means of a toner image thermal fixing type image forming apparatus can be made small without generating fixing failure or offset. This enables the provision of an image forming apparatus capable of stably outputting a fixed image having excellent quality, which requires a short waiting time and whose power consumption and rate of temperature rise are small. Furthermore, it is possible to use a thin fixing film over a long period of time without any problem involving wrinkles.

When abnormal energization occurs and the heat generating portion of the heating element is thereby overheated and burns or emits smoke due to anomaly in the power source or in the temperature control, the narrow portion melts and thereby disconnects the heat generating portion from its power source before the heat generating portion has been heated excessively. In consequence, overheating of the heat generating portion and burning or fuming of the heat generating portion can be prevented. The resulting heating element has a simple structure because no thermostatic switch or temperature fuse is incorporated, but it is reliable and effective as a safe device. It is to be understood that changes may be made without departing from the spirit and scope of the invention as set forth in the appended claims.

What is claimed is:

1. A fixing device comprising:

a heating element which remains in a fixed state during a fixing operation;

a film slidable relative to said heating element and movable with a recording material supporting a toner image which is heated by said heating element through said film, wherein said heating element includes:

a substrate;

a heat generating layer provided on the film side of said substrate electrodes through which said heat generating layer is energized, said electrodes being coated on said substrate so as to leave an open portion on the substrate surface; and an electrical contact point coated on said open portion on said substrate surface, said electrical contact point melting at a temperature higher than a fixing temperature for said toner image and lower than a withstanding temperature of said electrodes and of said substrate, said open portion provided on a side of said substrate opposite to the side on said heat generating layer is provided.

2. A fixing device according to claim 1, wherein said device further comprises pressing means for pressing a recording material on which a toner image is supported against said film.

3. A fixing device according to claim 1, wherein said open portion is provided within a fixing area.

4. A fixing device according to claim 1, wherein said open portion is provided at a position at which it faces said heat generating layer.

5. A fixing device according to claim 1, wherein said heat generating layer extends in a direction transverse to the direction of movement of said film.

6. A fixing device according to claim 1, wherein said heat element incorporates a temperature detecting element for detecting a temperature of said heating element, and is controlled such that it is heated to a predetermined temperature during the fixing.

7. A fixing device comprising:

a heating element fixedly supported during a fixing operation;

a film slidable relative to said heating element and moveable with a recording material supporting a toner image which is heated by said heating element through said film, wherein said heating element includes:

a substrate;

a heat generating layer provided on said substrate and extending in a direction transverse to the direction of movement of said film; and electrodes through which said heat generating layer is energized, said heat generating layer having outside of a fixing area a portion whose cross-sectional area is smaller than that of the portion of said heat generating layer located within the fixing area.

8. A fixing device according to claim 7, wherein said heat generating layer extends in a direction perpendicular to the direction of movement of said film.

9. A fixing device according to claim 7, wherein said heat generating layer has a wire-like form, and wherein said portion of said heat generating layer whose cross-sectional area is small has a small width.

10. A fixing device according to claim 7, wherein said heat generating layer has a wire-like form, and wherein said portion of said heat generating layer whose cross-sectional area is small is thin.

11. A fixing device according to claim 7, wherein said heat generating layer is made of a single material.

12. A fixing device according to claim 7, wherein, when said heat generating layer is heated to an abnormally high temperature, said portion whose cross-sectional area is small melts first, and thereby disconnects the portion of said heat generating layer located within the fixing area from its power source.

13. A fixing device according to claim 7, wherein said heating element incorporates a temperature detecting element for detecting the temperature of said heating body, and is controlled such that it is heated to a predetermined temperature during the fixing operation.

14. A fixing heater slidable relative to a film comprising:

a substrate;

a heat generating layer provided on said substrate;

electrodes through which said heat generating layer is energized, said electrodes being coated on said substrate so as to leave an open portion of said substrate surface; and an electrical contact point coated on said open portion on said substrate surface, said electrical contact point melting at a temperature higher than a fixing temperature for said toner image and lower than a withstanding temperature of said electrodes and said substrate, said open portion provided on a side of said substrate opposite to the side on which said heat generating layer is provided.

15. A fixing heater according to claim 14, wherein said heat generating layer has a wire-like form, and wherein said open portion is provided within a heat generated area of said heat generating layer which extends in a longitudinal direction thereof.

16. A fixing heater according to claim 14, wherein said open portion is provided at a position at which it faces said heat generating layer.

17. A fixing heater according to claim 14, further including a temperature detecting element for detecting the temperature of said substrate, and a control means for controlling the energization of said heat generating layer on the basis of an output of said temperature detecting element.

18. A fixing heater according to claim 14, characterized in that it remains in a fixed state during a fixing operation.

19. A fixing heater comprising:

a substrate;

a heat generating layer provided in wire form of a wire on said substrate; and electrodes through which said heat generating layer is energized, wherein said heat generating layer has at its end a portion whose cross-sectional area is smaller than that of a central area thereof.

20. A fixing heater according to claim 19, wherein said portion of said heat generating layer whose cross-sectional area is smaller has a small width.

21. A fixing heater according to claim 19, wherein said portion of said heat generating layer whose cross-sectional area is smaller is thin.

22. A fixing heater according to claim 19, wherein said heat generating layer is made of a single material.

23. A fixing heater according to claim 19, wherein, when said heat generating layer is heated to an abnormally high temperature, said portion whose cross-sectional area is smaller melts first, and thereby disconnects said central area of said heat generating layer from its power source.

24. A fixing heater according to claim 19, further including a temperature detecting element for detecting a temperature of said substrate, and a control means for controlling the energization of said heat generating layer on the basis of an output of said temperature detecting element.

25. A fixing heater according to claim 19, characterized in that it remains in a fixed state during a fixing operation.

26. A fixing device comprising:

a heating element which remains in a fixed state during a fixing operation;

a film slidable relative to said heating element and movable with a recording material supporting a toner image which is heated by said heating element through said film, wherein said heating element includes:

a substrate;

a heat generating layer provided on the film side said substrate;

electrodes through which said heat generating layer is energized, said electrodes being coated on said substrate so as to leave an open portion on the substrate surface; and an electrical contact point coated on said open portion, said electrical contact point melting at a temperature higher than a fixing temperature for said toner image and lower than a withstanding temperature of said electrodes and of said substrate, said open portion provided within a width in the direction perpendicular to the direction of sliding of said film.

27. A fixing device according to claim 26, wherein said open portion is provided on a side of said substrate opposite to the side on which said heat generating layer is provided.

28. A fixing device according to claim 26, further comprising pressing means for pressing a recording material on which a toner image is supported against said film and said open portion being provided within the width of said film and within the width being pressed by said pressing means.

29. A fixing device according to claim 27, wherein said open portion is provided within a fixing area.

30. A fixing device according to claim 27, wherein said open portion is provided at a position at which it faces said heat generating layer.

31. A fixing device according to claim 26, wherein said heat generating layer extends in the direction transverse to the direction of movement at said film.

32. A fixing device according to claim 26, wherein said open portion is provided on the same surface of said substrate as that on which said heat generating layer is provided.

33. A fixing device according to claim 32, wherein said open portion is provided outside of a fixing operation area.

34. A fixing device according to claim 26, wherein said heating element incorporates a temperature detecting element for detecting the temperature of said heating element, and said heating element is controlled such that it is heated to a predetermined temperature during the fixing operation.

35. A fixing heater comprising:

a substrate;

a heat generating layer provided on said substrate;

electrodes through which said heat generating layer is energized, and a safety element for breaking an electrical contact to said heat generating layer when the temperature rises excessively, wherein said heat generating layer has a wire-like form, and said safety element is provided within a heat generated area of said heat generating layer which extends in the longitudinal direction thereof.

36. A fixing device according to claim 35, wherein said safety element is provided on the surface of said substrate opposite to that on which said heat generating layer is provided.

37. A fixing device according to claim 35, wherein said safety element is provided at a position at which it faces said heat generating layer.

38. A fixing device according to claim 35, further including a temperature detecting element for detecting the temperature of said substrate, and a control means for controlling the energization of said heat generating layer on the basis of an output of said temperature detecting element.

39. A fixing device according to claim 38, wherein said safety element and said temperature detecting element are provided on the same surface of said substrate.

40. A fixing device according to claim 35, wherein said electrodes are coated on said substrate so as to leave an open portion on the substrate surface, said safety portion being an electrical contact point formed on said open portion with materials having a melting point lower than that of said electrodes.

41. A fixing device comprising:

a heating element which remains in a fixed state during a fixing operation; and a film slidable to said heating element and movable with a recording material supporting a toner image which is heated by said heating element through said film, wherein said heating element includes:

a substrate;

a heat generating layer provided on said substrate;

electrodes through which said heat generating layer is energized; and a safety element for breaking electric contact to said heat generating layer when the temperature rises a predetermined amount, wherein said heat generating layer has a wire-like form, and said safety element is provided within a heat generated area of said heat generating layer which extends in the longitudinal direction thereof.

42. A fixing device according to claim 41, wherein said safety element is provided on the surface of said substrate opposite to that on which said heat generating layer is provided.

43. A fixing device according to claim 41, wherein said safety element is provided at a position at which it faces said heat generating layer.

44. A fixing device according to claim 35, further including a temperature detecting element for detecting the temperature of said substrate, and a control means for controlling the energization of said heat generating layer on the basis of an output of said temperature detecting element.

45. A fixing device according to claim 44, wherein said safety element and said temperature detecting element are provided on the same surface of said substrate.

46. A fixing device according to claim 41, wherein said electrodes are coated on said substrate so as to leave an open portion on the substrate surface, said safety portion being a electrical contact point formed on said open portion with materials having a melting point is lower than that of said electrodes.

* * * * *

UNITED STATES PATENT AND TRADEMARK OFFICE

CERTIFICATE OF CORRECTION

PATENT NO. : 5,083,168

DATED : January 21, 1992

INVENTOR(S) : KUSAKA et al.

It is certified that error appears in the above-identified patent and that said Letters Patent is hereby corrected as shown below:

COLUMN 1

Line 19, "warming up" should read --warming-up--.
Line 22, "Ser. No. 206.767," should read --Ser. No. 206,767,--.
Line 24, "warming up" should read --warming-up--.
Line 35, "warming up" should read --warming-up--.
Line 43, "warming up" should read --warming-up--.

COLUMN 3

Line 21, "cleaner 12." should read --cleaner--.
Line 62, "polyketonesulfide (PKS)" should read --polyketonesulfide (PKS).--

COLUMN 4

Line 25, "substrate 22" should read --substrate 21--.

COLUMN 5

Line 13, "the" should be deleted.

COLUMN 7

Line 23, "warming up" should read --warming-up--.
Line 64, "Ta2N," should read --$Ta_2N$,-- and Ru02" should read --$RuO_2$--.

COLUMN 8

Line 1, "RuO2" should read --$RuO_2$--.

UNITED STATES PATENT AND TRADEMARK OFFICE

CERTIFICATE OF CORRECTION

PATENT NO. : 5,083,168

DATED : January 21, 1992

INVENTOR(S) : KUSAKA et al.

It is certified that error appears in the above-identified patent and that said Letters Patent is hereby corrected as shown below:

COLUMN 10

Line 1, "device. It" should read --device. ¶It--.
Line 16, "substrate" should read --substrate;--.
Line 27, "on said" should read --on which said--.
Line 42, "heat element" should read --heating element--.
Line 46, "fixing." should read --fixing operation.--.
Line 51, "moveable" should read --movable--.

COLUMN 11

Line 18, "body" should read --element--.
Line 56, "of a" should be deleted.
Line 57, "wire" should be deleted.

COLUMN 12

Line 27, "side said" should read --side of said--.
Line 31, "on" should read --of--.
Line 58, "at" should read --of--.

COLUMN 13

Line 17, "fixing device" should read --fixing heater--.
Line 21, "fixing device" should read --fixing heater--.
Line 25, "fixing device" should read --fixing heater--.
Line 31, "fixing device" should read --fixing heater--.
Line 34, "fixing device" should read --fixing heater--.

UNITED STATES PATENT AND TRADEMARK OFFICE

CERTIFICATE OF CORRECTION

PATENT NO. : 5,083,168

DATED : January 21, 1992

INVENTOR(S) : KUSAKA et al.

It is certified that error appears in the above-identified patent and that said Letters Patent is hereby corrected as shown below:

COLUMN 14

Line 26, "fixing device" should read --fixing heater--.
Line 32, "fixing device" should read --fixing heater--.
Line 38, "a" should read --an--.
Line 40, "is" should be deleted.

Signed and Sealed this

Twenty-second Day of June, 1993

*Attest:*

Michael K. Kirk

MICHAEL K. KIRK

*Attesting Officer*

*Acting Commissioner of Patents and Trademarks*